United States Patent [19]

Fringeli

[11] 3,954,740

[45] May 4, 1976

[54] BIS-S-TRIAZINYLAMINO-STILBENE-2,2'-DISULPHONIC ACIDS, THEIR MANUFACTURE AND THEIR USE AS OPTICAL BRIGHTENERS

[75] Inventor: Werner Fringeli, Basel, Switzerland

[73] Assignee: Ciba-Geigy Corporation, Ardsley, N.Y.

[22] Filed: Jan. 23, 1974

[21] Appl. No.: 435,785

[30] Foreign Application Priority Data

Feb. 2, 1973 Switzerland ..... 1561/73

[52] U.S. Cl. ..... 260/240 B; 162/162; 252/301.23; 427/158

[51] Int. Cl.[2] ..... C07D 403/12

[58] Field of Search ..... 260/240 B; 162/162; 427/158; 252/301.2 W

[56] References Cited

UNITED STATES PATENTS

| | | | |
|---|---|---|---|
| 3,018,287 | 1/1962 | Fleck | 252/301.2 W |
| 3,723,425 | 3/1973 | Ackermann | 260/240 B |

FOREIGN PATENTS OR APPLICATIONS

| | | | |
|---|---|---|---|
| 2,145,384 | 3/1972 | Germany | |
| 6,606,446 | 11/1967 | Netherlands | 260/240 B |
| 1,008,457 | 4/1963 | United Kingdom | 260/240 B |

OTHER PUBLICATIONS

Merck Index, 6th Edition, 1952, p. 621.

*Primary Examiner*—Arthur P. Demers
*Attorney, Agent, or Firm*—Joseph G. Kolodny; Edward McC. Roberts; Prabodh I. Almaula

[57] ABSTRACT

The present invention provides new bis-s-triazinylamino-stilbene-2,2'-disulphonic acids of the formula

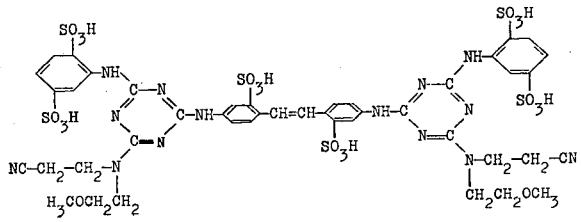

and the alkali metal, alkaline earth metal, earth metal, ammonium or amine salt thereof.

The new compounds are valuable optical brighteners, especially for whitening paper in combination with the surface finishing.

5 Claims, No Drawings

BIS-S-TRIAZINYLAMINO-STILBENE-2,2'-DISULPHONIC ACIDS, THEIR MANUFACTURE AND THEIR USE AS OPTICAL BRIGHTENERS

The present invention relates to a new bis-s-triazinylamino-stilbene-2,2'-disulphonic acid and salts thereof, to a process for their manufacture, and to their use as optical brighteners in surface coating compositions for paper.

Numerous bis-s-triazinylamino-2,2'-disulphonic acids which are substituted in the most different ways are already known. For example, compounds which carry substituents which cyano groups at the triazine ring are described in U.S. Pat. No. 3.018.287 and in French Pat. No. 2.075.072.

A compound has now been discovered which has nowhere been concretely described up till now and which cocnsitutes an optical brightener with particularly advantageous properties.

The new compound has the formula

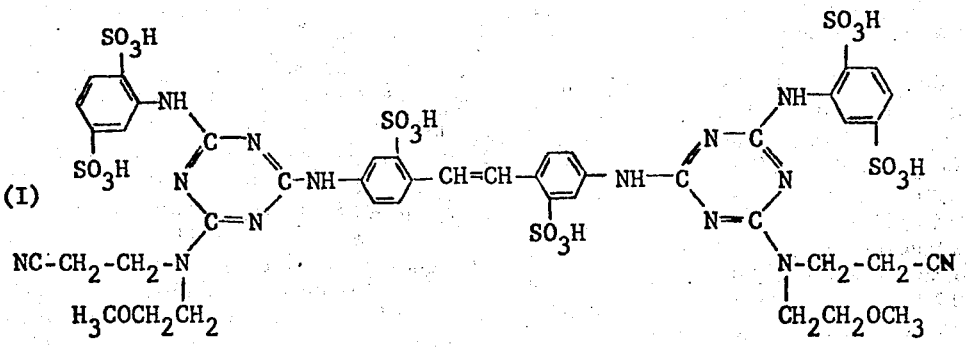

(I)

as does the alkali metal, salt, e.g. sodium or potassium salt, alkaline earth metal salt, e.g. calcium salt, earth metal salt, e.g. aluminium salt, ammonium, or amine salt.

The compound of the formula (I) is preferably in the form of the free acid or of the potassium or, especially, sodium salt.

The compound of the formula (I) is manufactured by methods which are known per se. For example it is possible to react 2 moles of the compound of the formula

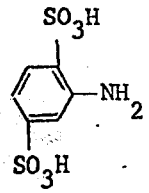

(II)

or of the salts thereof, in an aqueous medium and optionally in the presence of acid acceptors, first with 2 moles of cyanuric chloride and then with 1 mole of the compound of the formula

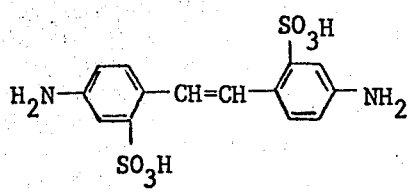

(III)

or of the salts thereof, and finally with 2 moles of the amine of the formula

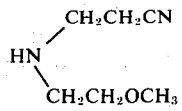

(IV)

It is, of course, also possible in the first reaction step to react initially one mole of the compound of the formula (III) with 2 moles of cyanuric chloride and then to react the resulting primary product with 2 moles of the compound of the formula (II) and finally with 2 moles of the compound of the formula (IV).

The first reaction step is carried out preferably at temperatures below 10°C, the second step at 0°–30°C, and the final step at 50°–100°C. Suitable acid acceptors which are optionally used are carbonates, bicarbonates, hydroxides or acetates of alkalies. The reaction can be carried out both in pure aqueous medium as well as in a mixture of water and hydrophilic organic solvents which are inert towards the reactants. Primarily low molecular ketones, e.g. acetone or methyl ethyl ketone, are suitable as such solvents. The very readily water-soluble end product of the formula (I) is precipitated in easily filterable form from its aqueous solutions preferably by being salted out, for example with alkali chlorides. Another method of isolation consists in evaporating the reaction solution to dryness in vacuo. A less pure product is obtained by this last mentioned method of isolation.

The salts of the new stilbene compound can be converted into the free sulphonic acids by treatment with strong mineral acids, for example 20% hydrochlorid acid. The generally very readily water-soluble amine salts can then be obtained from the free sulphonic acids by neutralisation with ammonia or readily water-soluble primary, secondary, or tertiary aliphatic or hydroaromatic amines. It is also possible to obtain acid salts by a milder acid treatment of the alkali of the alkali salts of the new stilbene compounds. These acid salts can likewise be converted into readily soluble products by neutralisation with low molecular amines.

The new fluorescent whitening agent, which in the form of its sodium or potassium salts is a colourless to slightly yellowish powder, is so readily soluble in water that it is possible to prepare 10–25% liquid preparations, a fact which is greatly appreciated by consumers.

The new stilbene compound of the formula (I) is eminently suitable for whitening paper in combination with the surface finishing, especially in the coating of art paper.

The methods of surface coating employed for the surface finishing of paper are to be understood as comprising in general all operations which are concerned with the finishing of crude paper by coating it with a finishing agent.

The surface finishing of paper is ordinarily carried out in practice by the following methods:

A. the so-called "starch coating" within the paper machine, e.g. in a size press, or B. the so-called "pigment coating" within or outside the paper machine.

For the starch coating (surface sizing according to A), aqueous size liquors are used which contain as a rule per liter 0.1 to 8 g, e.g. 0.2 to 5 g, of optical brightener of the formula (1), 10 to 200g/1 of binding agent per liter and optionally a small amount of conventional wetting agents.

For the pigment coating according to (B), coating liquors are used as a rule which contain per liter 0.1 to 8 g, preferably 0.2 to 5 g, of optical brightener of the formula (1), e.g 50–700 g/1, preferably 350–650 g/1, of white pigment and optionally (based on the weight of the white pigment or pigments used), e.g. 5 to 40%, preferably 8–30%, of a binder, for example 0.1 to 1%, preferably 0.2–0.6% of metal binding agents and e.g. 0.1 to 1% preferably 0.2 to 0.6% of wetting agent.

Suitable binders are, for example, decomposed starches, alginates, polyvinyl alcohol, polyvinyl pyrrolidone, carboxymethyl cellulose, proteins (e.g. gelatine, casein), aqueous synthetic resin dispersions based on butadienestyrene or acrylic polymers or copolymers, or mixtures of these binders.

Pigment coating, which contains casein as binder, is also termed art-print coating.

Wetting agents are, for example, unsulphated or sulphated higher alkanol- or alkylphenol polyglycol ethers with an alkyl radical containing from 8–14 carbon atoms and 1–20 ethylene oxide groups.

As white pigments it is possible to use e.g. aluminium magnesium silicates (china clay), calcium carbonate, $CaSO_4 \cdot 1OH_2O$ (satin white), aluminium silicates and hydroxides, barium sulphate (blanc fixe) or titanium dioxide or mixtures of such white pigments. Furthermore, the coating liquors may contain metal binding agents, e.g. water-soluble poly-or metaphosphates + polycarboxylic salts, in order to eliminate undesirable traces of metal (e.g. $Fe^{III}$).

In order to obtain good flow properties it is advantageous to use an alkaline coating liquor for the pigment coating. The alkaline reaction is advantageously adjusted with ammonium hydroxide or with sodium or potassium hydroxides, carbonates or borates or mixtures thereof.

With these coating liquors according to (A) and (B) the paper is advantageously coating device conventionally used for this purpose. Paper is thereby obtained which display a whiter and more pleasing appearance in addition to an improved surface and printability.

In the surface finishing process the paper is coated in known manner, in the course of which the solutions of fluorescent whitening agents are added to the already prepared size liquors or coating liquors.

As a rule aqueous solutions of fluorescent whitening agents of 0.01–5%, preferably 0.05–2%, are used.

EXAMPLE 1

77.5 g of cyanuric chloride are dissolved in 300 g of acetone and the solution is added with stirring to 2000 g of ice water. Over the couse of 30 minutes, a solution of 125 g of the sodium salt of 1-aminobenzene-2,5-disulphonic acid in 700 ml of water is passed into the resulting cyanuric chloride suspension at −5° to + 5°C and the liberated acid is neutralised with a 15% sodium carbonate solution, so that the pH of the mixture remains 3 to 4. The mixture is subsequently stirred for 4 hours at 0° to 5°C and pH 3 to 4. The clear reaction solution is then treated with a solution of 82.8 g of sodium-4,4'-diaminostilbene-2,2'-disulphonate in 600 ml of water, the pH is kept at 7 with sodium bicarbonate solution, and the mixture is stirred for 4 hours at 20° to 30°C. After this time, the clear reaction solution contains virtually no more diazotisable amine. The solution of the resulting 4,4'-bis-[2-chloro-4-(2,5-disulphophenylamino)-s-triazinyl-(6)-amino]-stilbene-2,2'-disulphonic acid and the hexasodium salt thereof is then treated with 60 g of 2-cyanoethyl-(2-methoxyethyl)-amine and heated for 5 hours to 95° to 100°C in a descending condenser, in the course of which the pH of the reaction mixture is kept between 8 and 9 by addition of a 15% sodium hydroxide solution. 600 g of common salt are then added to the clear reaction solution which is cooled to about 60°C, the precipitated product is filtered off with suction at room temperature and dried in vacuo at 80°C, to yield 368 g of a pale yellow, readily water-soluble powder of the compound of the formula

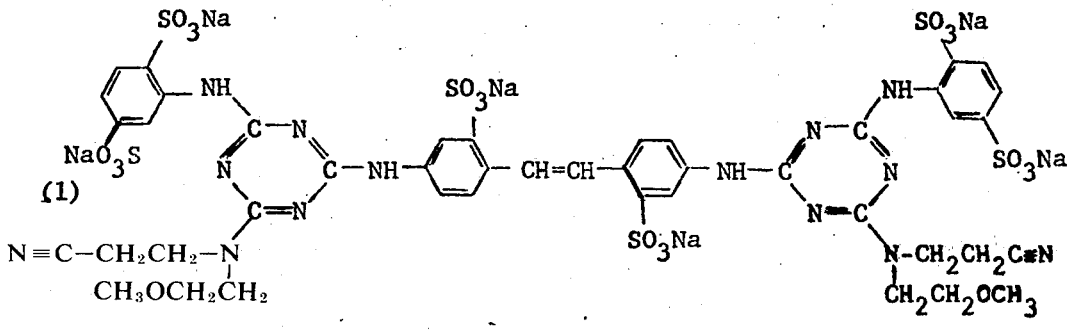

EXAMPLE 2

A solution is prepared of 2 g of the optical brightener of the formula (1) in 50 ml of hot (90°C) distilled water and a colloidal solution is prepared of 80 g of a decomposed starch in 1000 ml of hot (90°C) water. The optical brightener solution is then incorporated into the starch solution. The resulting solution has a pH of 5.5 to 7.

A sized printing paper is coated with this sizing liquor in a size press and the coated is dried at about 90°–120°C in the dryer section of the paper machine. A paper with a substantially improved degree of whiteness is thus obtained.

Instead of sized paper, it is also possible to use sized carboard with equal success.

EXAMPLE 3

5 g of the optical brightener of the formula (1) are dissolved in 40 ml of hot (90°C) distilled water. To this solution are then added 1000 ml of an aqueous coating liquor which contains the following constituents:

35 g of commercial casein
80 g of a resin dispersion with 50% resin content based on a butadiene-styrene polymer (e.g. DOW-LATEX 626, Dow Chem. USA),
1 g of sodium polyphosphate,
2g of sulphated dodecyl alcohol polyglycol ether with 15 ethylene oxide groups,
400 g of aluminium magnesium silicate (china clay) and
15 g of conc. ammonia.

The pH of this dispersion is about 9.0. Sized paper or cardboard is coated with this coating liquor on the surface in a size press or some other coating device. A coated paper of exceptional whiteness is obtained.

EXAMPLE 4

75 g of an anionic starch (e.g. Perfektamyl A 2177 17, AVEBE, Holland) are stirred cold in 600 ml of water and a colloidal solution is subsequently prepared therefrom at 80°–90°C. To this solution are added 2 g of sodium polyphosphate, 2 g of sulphated dodecyl alcohol polyglycol ether with 15 ethylene oxide groups, 3 ml of concentrated ammonia, 75 g of a 50% resin dispersion based on a butadiene-styrene copolymer (e.g. DOX-LATEX 636, Dow Chem. Corp., USA), a solution of 0.5 g of the fluorescent whitener of the formula (1) in 400 ml of water, and, finally, 500 g of an aluminium magnesium silicate white pigment, and the whole is stirred to give a homogeneous suspension.

A sized crude paper, consisting of 50% of bleached sulphite cellulose and wood pulp respectively and having a surface pH of 4, is coated with the above coating liquor in a coating apparatus. A very fine, white, readily printable paper is obtained which can be used e.g. in off-set printing.

The addition of larger amounts of fluorescent whitener, e.g. 2 or 8 g, does not cause any undesirable discolouration, but intensifies the white effect. The white effect is substantially increased by adding to the coating liquor described hereinabove 4 g polyvinyl alcohol as extender.

EXAMPLE 5

A pigment coating liquor of the following composition is prepared: 150 ml of a 50% aqueous resin dispersion based on a cross-linkable methylacrylate/methylmethacrylate/styrene copolymer (e.g. ACRONAL S 320 D, BASF, Ludwigshafen am Rhein, Germany), 100 ml of water containing 2 g of sodium polyphosphate, 600 ml of water containing 4 g of the fluorescent whitener of the formula (1), 50 ml of water containing 2 g of nonylphenolpentadecaglycol ether and 500 g aluminium silicate (china clay Dinkie A).

A sized and weighted sulphite cellulose crude paper is coated with this treatment liquor and subsequently dried. A brilliant white, readily printable paper is obtained.

EXAMPLE 6

An art-print coating liquor with a pH of 11 is obtained by mixing together 500 ml of water containing 1 g of the optical brightener of the formula (1), 35 g of casein, 12 ml of concentrated ammonia, 75 ml of water containing 7.5 g of sodium carbonate, 80 ml of a 50% resin dispersion based on a butadiene/styrene copolymer (e.g. DOW LATEX 636), 50 ml of water containing 1 g of sodium polyphosphate, 300 g of aluminium magnesium silicate (china clay SPS), 250 g of 40% $CaSO_4.1OH_2O$ (satin white) and 50 ml of water containing 2 g of sulphated dodecyl alcohol polyglycol ether with 10 to 20 ethylene oxide groups.

Sized paper or carboard is coated with this coating paper on the surface in a size press or some other coating apparatus. A coated paper of exceptional whiteness is obtained.

I claim:

1. The compound of the formula

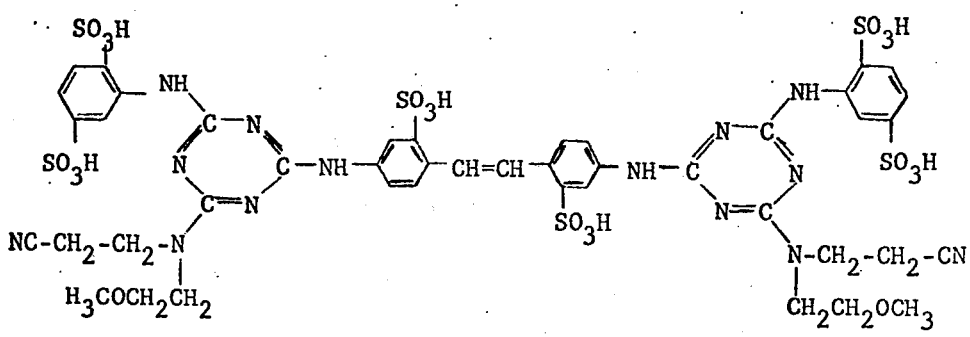

and the alkali metal, alkaline earth metal, earth metal, ammonium or amine salt thereof.

2. The compound according to claim 1, of the formula

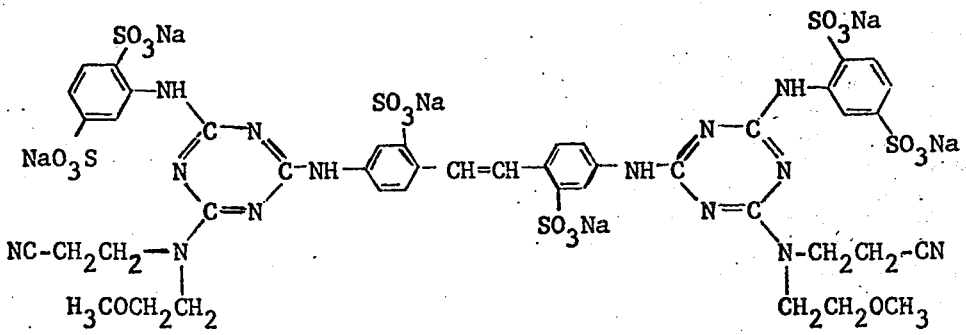

3. A method of treating paper with optical brighteners, which comprises incorporating a compound defined in claim 1 into the coating composition for the surface treatment of paper and applying said coating composition to the paper.

4. A method according to claim 3, which comprises incorporating the optical brightener into art-print coating compositions.

5. Paper containing 0.0001 to 2% of a compound as defined in claim 1.

* * * * *

Notice of Adverse Decision in Interference

In Interference No. 100,055, involving Patent No. 3,954,740, W. Fringeli, BIS-S-TRIAZINYLAMINO-STILBENE - 2,2 - DISULPHONIC ACIDS, THEIR MANUFACTURE AND THEIR USE AS OPTICAL BRIGHTENERS, final judgment adverse to the patentee was rendered Mar. 5, 1980, as to claims 1, 2, 3 and 5.

[*Official Gazette June 10, 1980.*]